US005208566A

United States Patent [19]

Kenoun et al.

[11] Patent Number: 5,208,566

[45] Date of Patent: May 4, 1993

[54] DIELECTRIC FILTER HAVING ADJACENTLY-POSITIONED RESONATORS OF DISSIMILAR CROSS-SECTIONAL DIMENSIONS AND NOTCHED SIDE SURFACE

[75] Inventors: Robert Kenoun, Prospect Heights; Darioush Agahi-Kesheh, Buffalo Grove, both of Ill.

[73] Assignee: Motorola, Inc., Schaumburg, Ill.

[21] Appl. No.: 823,227

[22] Filed: Jan. 21, 1992

[51] Int. Cl.[5] ..... H01P 1/205

[52] U.S. Cl. ..... 333/206; 333/222

[58] Field of Search ..... 333/202, 206, 207, 222, 333/223, 235, 134; 29/600; 427/126.2

[56] References Cited

U.S. PATENT DOCUMENTS

| | | | |
|---|---|---|---|
| 4,431,977 | 2/1984 | Sokola et al. | 333/206 |
| 4,464,640 | 8/1984 | Nishikawa et al. | 333/202 |
| 4,673,902 | 6/1987 | Takeda et al. | 333/206 X |
| 4,733,208 | 3/1988 | Ishikawa et al. | 333/206 X |
| 4,742,562 | 5/1988 | Kommrusch | 333/202 X |
| 4,890,079 | 12/1989 | Sasaki | 333/206 |
| 5,109,207 | 4/1992 | Aizawa et al. | 333/206 X |

FOREIGN PATENT DOCUMENTS

| | | | |
|---|---|---|---|
| 0280101 | 12/1986 | Japan | 333/202 |

*Primary Examiner*—Robert J. Pascal
*Assistant Examiner*—Seung Ham
*Attorney, Agent, or Firm*—Robert H. Kelly

[57] ABSTRACT

A dielectric filter construction having at least two resonating cavities extending longitudinally through a block of dielectric material. At least one of the resonating cavities is of a cross-sectional area which is elongated in a transverse direction, and at least one notch is formed to extend longitudinally along at least one of the surfaces of the block of dielectric material between adjacent ones of the resonating cavities. By appropriate selection of the amount of elongation of the cross-section of the resonating cavity, and the location and dimension of the notch formed along the surface of the block, the component values of the component elements comprising the filter may be selected over an increased range without altering the physical size of the filter.

9 Claims, 4 Drawing Sheets

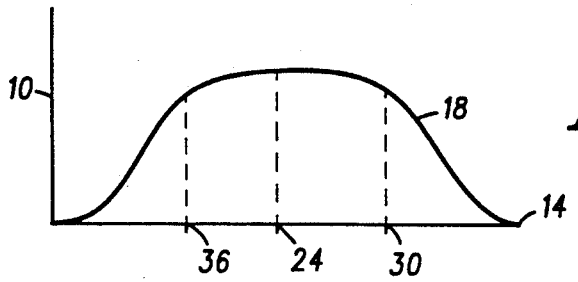
FIG. 1
FIG. 2
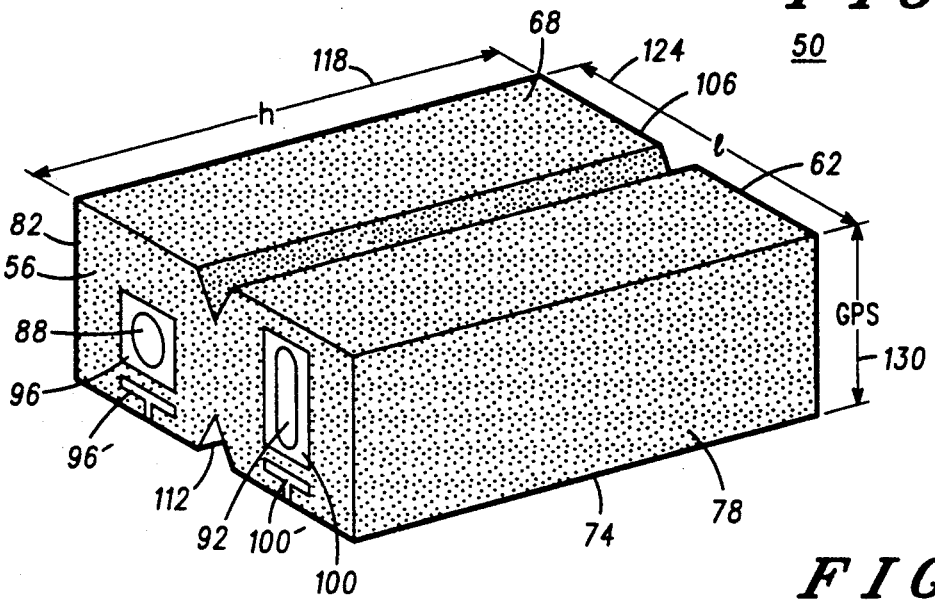
FIG. 3
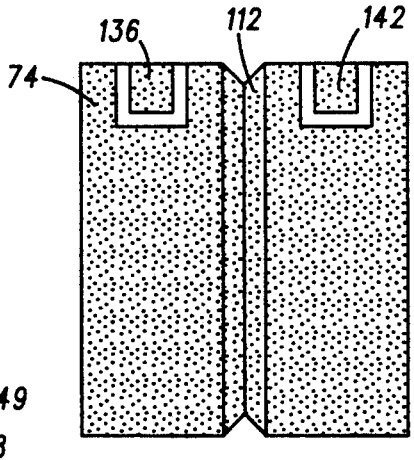
FIG. 4
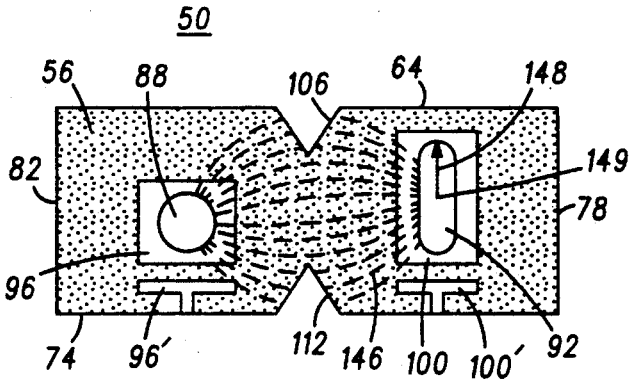

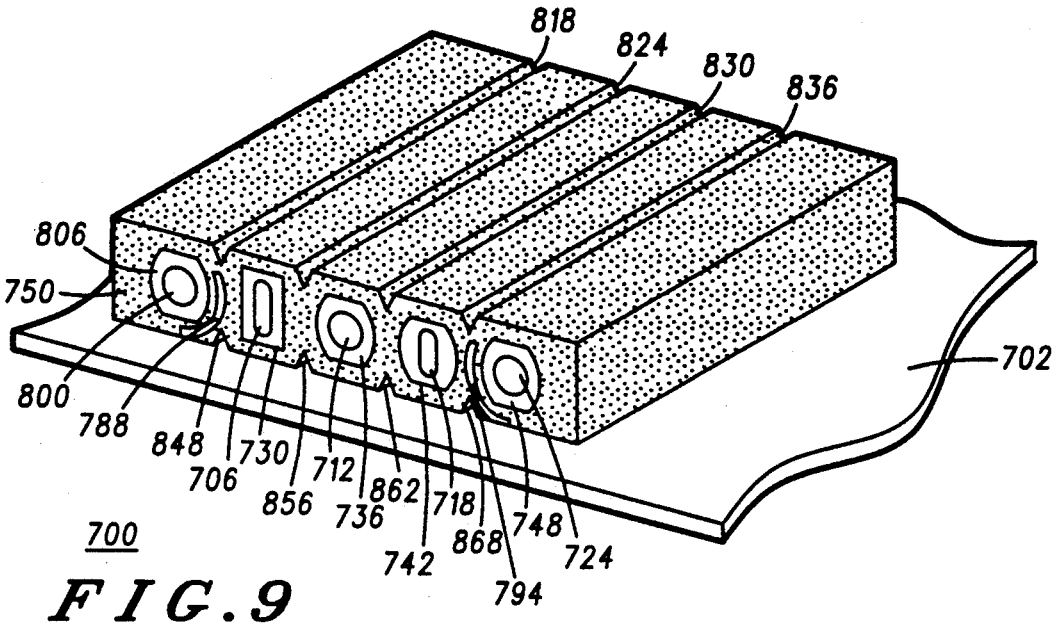
FIG. 9
FIG. 11
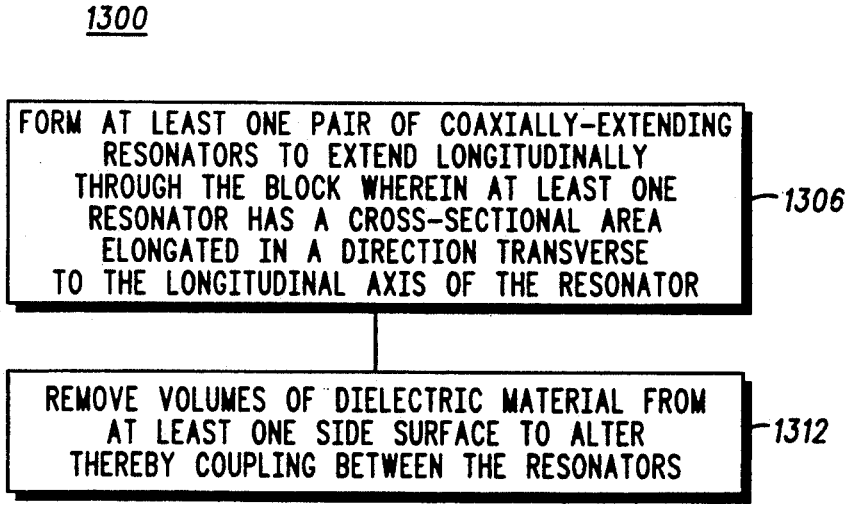

DIELECTRIC FILTER HAVING ADJACENTLY-POSITIONED RESONATORS OF DISSIMILAR CROSS-SECTIONAL DIMENSIONS AND NOTCHED SIDE SURFACE

BACKGROUND OF THE INVENTION

The present invention relates generally to dielectric filters, and, more particularly, to a dielectric block filter construction of a design which minimizes the physical dimensions thereof.

Advancements in the field of radio electronics have permitted the introduction and commercialization of an ever-increasing array of radio communication apparatus. Advancements in electronic circuitry design have also permitted increased miniaturization of the electronic circuitry comprising such radio communication apparatus. As a result, an ever-increasing array of radio communication apparatus comprised of ever-smaller electronic circuitry has permitted the radio communication apparatus to be utilized more conveniently in an increased number of applications.

A radio transceiver, such as a radiotelephone utilized in a cellular, communication system, is one example of radio communication apparatus which has been miniaturized to be conveniently utilized in an increased number of applications. Additional efforts to miniaturize further the electronic circuitry of such radio transceivers, as well as other radio communication apparatus, are being made. Such further miniaturization of the radio transceivers will further increase the convenience of utilization of such apparatus, and will permit such apparatus to be utilized in further increased numbers of applications.

Pursuant to such efforts to miniaturize further the electronic circuitry comprising radio transceivers, as well as other radio communication apparatus, size minimization of the electronic circuitry comprising such is a critical design goal during circuit design.

Dielectric block filters, comprised of a ceramic material, frequently comprise a portion of the circuitry of such radio transceivers. Such dielectric block filters are advantageously utilized for reasons of cost, simplicity of manufacture, ease of installation upon an electrical circuit board, and good filter characteristics at frequencies (typically in the megahertz and gigahertz range) at which such transceivers usually are operative.

To form a filter of a block of dielectric material, holes are bored, or otherwise formed, to extend through the dielectric block, and sidewalls defining such holes are coated with an electrically-conductive material, such as a silver-containing material. The holes formed thereby form resonators which resonate at frequencies determined by the lengths of the holes.

Typically, substantial portions of the outer surfaces of the dielectric block are similarly coated with the electrically-conductive material. Spaced-apart portions of a top surface of the dielectric block are also typically coated with the electrically-conductive material whereby such portions become capacitively coupled theretogether. The resonators, due to electromagnetic intercoupling between adjacent ones of the resonators, and the portions of the top surface of the block due to capacitive coupling, together define a filter having filter characteristics for filtering a signal applied thereto.

The precise filter characteristics of such a filter can be controlled by controlling the capacitive intercouplings (and, hence, capacitive values of the capacitive elements formed thereof) and the spacing between adjacent ones of the resonators (and, hence, inductive values of the inductive elements formed thereof).

Historically, the component value of the elements comprising such a filter, and, hence, the filter characteristics of the filter formed therefrom, have been controlled in two ways. First, the capacitive values of the capacitive elements formed upon the top surface of the dielectric block are altered, and, second, the spacings between the adjacent ones of the resonators are altered.

Alteration of the capacitive values of the capacitive elements formed upon the top surface of the dielectric block is becoming a less viable means of altering the filter characteristics of a dielectric filter as the physical dimensions of such filters are reduced. The capacitive values of such capacitive elements are dependent upon the physical dimensions of the coated areas forming such elements as well as their relative spacings therebetween. Both the physical dimensions of such coated areas and their relative spacings therebetween are reduced as the physical dimensions of such filters are reduced. As a result, the range of capacitive values of which capacitive elements formed therefrom is reduced. Accordingly, alteration of the filter characteristics of such a filter constructed in such manner has become increasingly limited.

Alteration of the spacings between adjacent ones of the resonators is becoming a less viable means for altering the filter characteristics of a dielectric filter for similar reasons. As the physical dimensions of such filters are reduced, permissible increases in spacing between adjacent ones of the resonators are reduced. As a result, the range of inductive values of which the resonators may take is reduced. Accordingly, alteration of the filter characteristics of such a filter in such manner has become increasingly limited.

Accordingly, what is needed is a dielectric filter construction, and means for making such, permitting component elements thereof to be selected over a wide range of values without requiring increase in the physical dimensions of the filter.

SUMMARY OF THE INVENTION

The present invention, accordingly, provides a dielectric filter construction, and associated method, which permits the component values of the component elements comprising the dielectric filter to be of any of a wide range of values to permit thereby a filter to be constructed of desired filter characteristics.

The present invention further advantageously provides a dielectric filter construction in which at least one resonator forming a portion of the dielectric filter is of a cross-sectional area elongated in a transverse direction thereof.

The present invention yet further advantageously provides a dielectric filter construction having at least one notch formed along at least one of the surfaces of the filter to alter thereby electromagnetic couplings between individual ones of the resonators which comprise portions of the dielectric filter.

The present invention includes further advantages and features, the details of which will become more apparent by reading the detailed description of the preferred embodiments hereinbelow.

In accordance with the present invention, therefore, a filter construction for generating a filtered signal responsive to application of an input signal thereto is disclosed. The filter construction comprises a dielectric block defining top, bottom, and at least first and second side surfaces. At least one pair of coaxially-extending resonators are formed to extend longitudinally along longitudinal axes thereof between the top and bottom surfaces of the dielectric block. Individual ones of the resonators of the at least one pair of resonators are spaced apart from one another by distances permitting the electromagnetic coupling between the resonators. At least one resonator of the at least one pair of coaxially-extending resonators is of a cross-sectional area elongated in a direction transverse to the longitudinal axis of the resonator. The electromagnetic coupling between individual ones of the resonators of the at least one pair of resonators is altered along at least one of the first and second side surfaces of the dielectric block at a location between the individual ones of the at least one pair of coaxially-extending resonators.

BRIEF DESCRIPTION OF THE DRAWINGS

The present invention will be better understood when read in light of the accompanying drawings in which:

FIG. 1 is a graphical representation of the frequency response of a bandpass filter, such as a bandpass filter of any of the preferred embodiments of the present invention;

FIG. 2 is a schematic representation of a dielectric block filter of a preferred embodiment of the present invention;

FIG. 3 is a view taken from beneath a side surface of the dielectric filter of FIG. 2;

FIG. 4 is a plan view taken from above the top surface of the dielectric filter of FIG. 2;

FIG. 9 is a schematic representation of a dielectric filter constructed to correspond to the circuit diagram of FIG. 8;

FIG. 11 is a logical flow diagram listing the method steps of the method of a preferred embodiment of the present invention.

DESCRIPTION OF THE PREFERRED EMBODIMENTS

Figure 5:
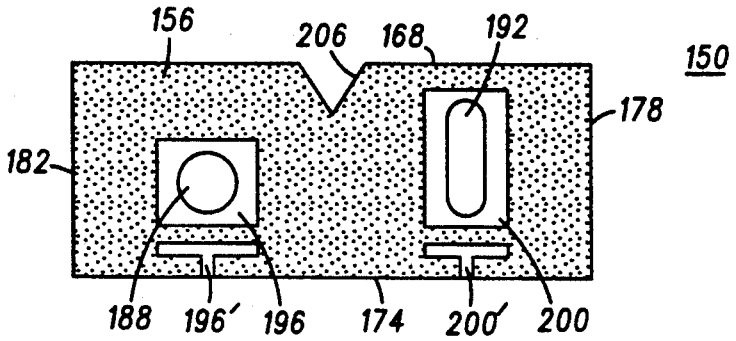
FIG. 5 is a plan view, similar to that of FIG. 4, but taken from above the top surface of a dielectric filter of an alternate, preferred embodiment of the present invention.

Turning first to the graphical representation of FIG. 1, the frequency response of a bandpass filter is graphically represented. Ordinate axis 10 is scaled in terms of a power-related value, such as decibels, and abscissa axis 14 is scaled in terms of frequency. Curve 18 is a plot of the frequency response of a bandpass filter over a range of frequencies. A bandpass filter is typically defined in terms of a center frequency, designated in the figure by reference numeral 24, and upper and lower cut off frequencies, designated in the figure by reference numerals 30 and 36, respectively.

The range of frequencies extending between the upper and lower cut off frequencies of the bandpass filter define the passband of the filter. Component portions of a signal applied to the filter of frequencies within the passband of the filter are passed by the filter; component portions of the signal applied to the filter of frequencies beyond the passband of the filter are attenuated by the filter.

Any nonideal filter, however, causes a certain amount of attenuation of a signal applied thereto, even of component portions of frequencies within the bandpass of the filter. The amount of such undesired attenuation is referred to as the insertion loss of the filter. The efficiency of the filter is, hence, determinative of the insertion loss thereof. A dielectric filter construction typically exhibits a lower insertion loss at frequencies at which a radio transceiver is typically operative.

Turning now to the schematic representation of FIG. 2, a dielectric filter, referred to generally by reference numeral 50, of a preferred embodiment of the present invention is shown. Filter 50 is generally block-like in configuration, and is comprised of a dielectric material. Filter 50 defines top surface 56, bottom surface 62, first side surface 68, second side surface 74, and front and rear side surfaces 78 and 82, respectively. A coating of an electrically-conductive material, typically a silver-containing material, is applied to substantial portions of bottom surface 62, and side surfaces 68, 74, 78, and 82. (As will be noted with respect to FIG. 3 hereinbelow, the coating of the electrically-conductive material applied to second side surface 74 is applied in a manner to form input and output coupling electrodes thereupon.)

Formed to extend longitudinally through the dielectric block, by a process of boring or otherwise, are at least two cavities, here indicated by reference numerals 88 and 92. Such longitudinally-extending cavities define longitudinal axes. The sidewalls defining cavities 88 and 92 are also coated with the same electrically-conductive material which coats outer surfaces of the dielectric block. At least one of the cavities, here cavity 92, is of a cross-sectional area which is elongated in a direction transverse to a longitudinal axis of the cavity. Cavity 92 is elongated in such transverse direction to be of an elliptical cross-sectional configuration.

Portions of top surface 56 are also coated with the same electrically-conductive material which coats side surfaces of the dielectric block and sidewalls which define cavities 88 and 92. Such portions are indicated in the figure by painted areas 96 (and 96') and 100 (and 100') formed around the openings defined by cavities 88 and 92, respectively. Painted areas 96 and 100 are spaced-apart from one another, and are thereby capacitively coupled theretogether. Painted areas 96 and 96' are also capacitively coupled theretogether as are painted areas 100 and 100'. The amount of capacitive coupling is determined by the size of painted areas 96 and 100 as well as the separation distance between areas 96 and 100.

Volumes of dielectric material along first and second side surfaces 68 and 74 of the filter are removed at locations of the side surfaces between cavities 88 and 92. Such removal of volumes of the dielectric material form V-shaped notches 106 and 112 which extend longitudinally along the lengths of side surfaces 68 and 74, respectively.

The dimensions of filter 50 are typically defined in terms of a heighthwise dimension, indicated by line segment 118 (and noted by letter "h"), a lengthwise dimension, indicated by line segment 124 (and noted by letter "l"), and a ground plane separation distance, indicated by line segment 130 (and noted by letters "gps").

The heighthwise dimension of the filter determines the length of resonating cavities 88 and 92 which extend longitudinally through the dielectric block. Such heighthwise dimension of the filter is typically essentially fixed, as the lengths of cavities 88 and 92 must be of lengths proportional to the wavelengths of oscillating signals applied to the filter to be filtered thereby. (As wavelength is inversely proportional to frequency, the lengths of cavities 88 and 92 are also related, in inverse proportion, to the frequencies of signals applied the filter.) Cavities 88 and 92 only form resonating cavities when the lengths of such cavities are proportional to the wavelengths of signals applied thereto. Hence, the heighthwise dimension of filter 50 is essentially fixed for any particular filter construction. During manufacture, there is some variance in the actual heighthwise dimension of the filter (and, hence, length of cavities 88 and 92) relative to the desired heighthwise dimension of the filter. Such slight variance in the desired versus actual dimension can be compensated for by removing portions of the electrically-conductive material coated upon top surface 56 of the filter.

Dielectric filter 50 is typically mounted upon an electrical circuit board by positioning second side surface 74 upon the surface of the circuit board. Once mounted, the filter extends above the surface of such circuit by a distance corresponding to the length of the ground plane separation distance. (The ground plane separation distance is defined as such as the electrically-conductive material coated upon the surfaces of the filter, including first and second side surfaces 68 and 74, are typically coupled to an electrical ground plane. Both first side surface 68 and second side surface 74 thereby form ground planes and the distance therebetween is, hence, referred to as the ground plane separation distance.) As electronic devices typically contain several electrical circuit boards stacked upon one another, the ground plane separation distance defines the minimum heighthwise spacing between such stacked, electrical circuit boards. As increase in the length of the ground plane separation distance would result in increased physical dimensions of a device incorporating such, the ground plane separation distance is also typically fixed to be of less than a maximum length.

The lengthwise dimension of a dielectric filter, indicated by line segment 124 in the Figure, historically has been the only the dimension of a dielectric block forming a filter which has not typically been limited to be of less than a maximum dimension. During filter design of a dielectric filter, such lengthwise dimension typically has been altered to alter the filter characteristics of such a filter.

However, as a result of efforts to miniaturize further electronic devices, design of such electronic devices now oftentimes also include limitations on the maximum lengthwise dimensions permitted of a dielectric filter. Accordingly, alteration of filter characteristics of a dielectric filter by increasing the lengthwise dimensions of the filter is oftentimes not permitted.

FIG. 3 is a view taken from beneath second side surface 74 of dielectric filter 50 of FIG. 2. As noted briefly hereinabove, the electrically-conductive material coated upon surface 74 is coated in a manner to form input and output coupling electrodes upon surface 74. The bottom view of FIG. 3 illustrates input coupler 136 and output coupler 142 formed upon surface 74. Input and output couplers 136 and 142 are electrically isolated from other portions of the electrically-conductive material coated upon surface 74. Preferably, couplers 136 and 142 are electrically connected to portions of the electrically-conductive material coated upon top surface 56. (Such connection is indicated in FIG. 2 by portions of painted areas 96' and 100' which extend to side surface 74.) Notch 112 is also shown to be formed to extend longitudinally along the length of surface 74.

FIG. 4 is a plan view taken from above top surface 56 of dielectric filter 50 of FIG. 2. Top surface 56 is again shown to include openings defined by cavities 88 and 92, painted areas 96' and 100', and edge surfaces of notches 106 and 112. Electromagnetic field lines 146 are also illustrated in the figure. Field lines 146 are representative of the electromagnetic coupling between resonating cavities 88 and 92 (along their respective lengths) upon application of a signal of certain frequencies thereto.

Historically, the amount of electromagnetic intercoupling between resonating cavities 88 and 92 has been altered by altering the separation distance between the respective cavities. To reduce the electromagnetic coupling between cavities 88 and 92, the distance between the cavities may be increased. However, as noted hereinabove, as a result of continuing efforts to miniaturize the circuitry of electronic devices, such increase in separation distance between resonating cavities is not possible as such an increase would result in increase of the lengthwise dimensions of the dielectric block.

Advantageously, however, it has been determined that the amount of electromagnetic coupling between the resonating cavities may also be reduced by removing some of the material of the dielectric block at a portion of the dielectric block between the two resonating cavities. Accordingly, the material may be removed along surfaces of the dielectric block at a portion of the dielectric block between the two resonating cavities. Notches 106 and 112 formed along surfaces 68 and 74, respectively, of dielectric filter 50 are operative, therefore, to decrease the electromagnetic coupling between resonating cavities 88 and 92. The depth of such notches define the amount of reduction of such electromagnetic coupling between the resonating cavities.

Elongation of the cross-sectional area of one or more of the resonating cavities, here elongation of the transverse axis of the cross-sectional area of cavity 92, can also be utilized to alter the filter characteristics of a dielectric filter. While resonating cavities of circular, cross-sectional areas minimize insertion loss of a dielectric filter, oftentimes, insertion loss is not a characteristic which must be minimized. For instance, a transmitter, clean-up filter which filters a signal prior to application to amplification circuitry does not require a filter which minimizes insertion loss. Elongation of the transverse axis of a cross-section of a resonating cavity alters the characteristics thereof. Such transverse axis is indicated in the figure by line segment 148. The longitudinal axis is indicated in the figure by point 149. Such alteration can be utilized to alter the filter characteristics of a dielectric filter.

During the construction of a dielectric filter, the desired filter topology is first determined. That is to say, a filter of a desired transfer function and, hence, filter characteristics is selected. If the component values of the component elements comprising a dielectric filter of such a topology cannot be embodied by a dielectric filter of physical dimensions of a dielectric filter specified by dimensional constraints, the transverse axis of one or more of the resonating cavities of the filter may be elongated. Additionally, one or more notches may be formed upon one or more side surfaces of the dielectric filter between the two of more resonators. In such manner, the range of values of which the component elements of the dielectric filter may take is increased. An increase in the number of filter topologies which may be formed of a dielectric filter of limited physical dimensions is made possible as the component values of the component elements of such a filter may be of an increased range of values.

Once the shape of the filter is determined, a mold is created having an inner diameter of the desired physical dimensions, including a notch of desired dimensions. Mated rods of dimensions corresponding to the desired dimensions of the resonating cavities of the dielectric material are positioned to extend through the mold. The mold and dielectric material therein is heated to create thereby the dielectric filter. Then, the electrically-conductive material is coated upon desired portions of the surfaces of the filter and upon the sidewalls of the resonating cavities. The filter may be tuned to alter slightly the frequency response of the filter by removing portions of the electrically-conductive material coated upon the top surface of the filter.

FIG. 5 is a plan view taken from above the top surface of a dielectric filter of an alternate, preferred embodiment of the present invention. The filter, referred to generally by reference numeral 150 includes top surface 156 defined by edges of first and second side surfaces 168 and 174, and front and rear surfaces 178 and 182. Openings upon top surface 156 are defined by longitudinally-extending cavities 188 and 192. Portions of top surface 156 are coated with and electrically-conductive material, here indicated by painted areas 196, 196', 200, and 200', wherein areas 196 and 200 are capacitively coupled theretogether. Filter 150 of FIG. 5 differs with the filter of FIGS. 2–4 in that the volumes of dielectric materials between cavities 188 and 200 are removed only from first side surface 168 to form notch 206. Dielectric material is not removed from second side surface 174.

Figure 6:
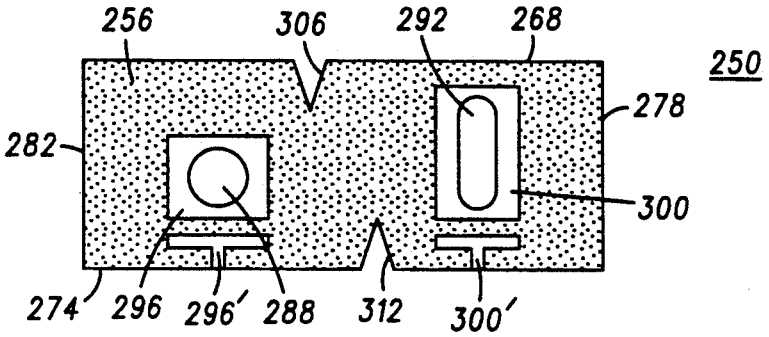
FIG. 6 is a plan view, similar to those of FIGS. 2–4, but taken from above the top surface of a dielectric filter of another alternate, preferred embodiment of the present invention.

FIG. 6 is a plan view taken from above the top surface of a dielectric filter of another alternate, preferred embodiment of the present invention. The filter, referred to generally by reference numeral 250, includes top surface 256 defined by edges of first and second side surfaces 268 and 274, and front and rear side surfaces 278 and 282. Openings upon top surface 256 are defined by longitudinally-extending cavities 296 and 292. Portions of top surface 256 are coated with an electrically-conductive material, here indicated by painted areas 296, 196', 300, and 300'. Areas 296 and 300 are capacitively coupled theretogether. Filter 250 of FIG. 6 differs with filter 50 of FIGS. 2–4 in that, while volumes of dielectric materials are removed from both first and second side surfaces 268 and 274 to form notches 306 and 312, such notches are formed locations of dissimilar distances between resonating cavities 288 and 292.

Figure 7:
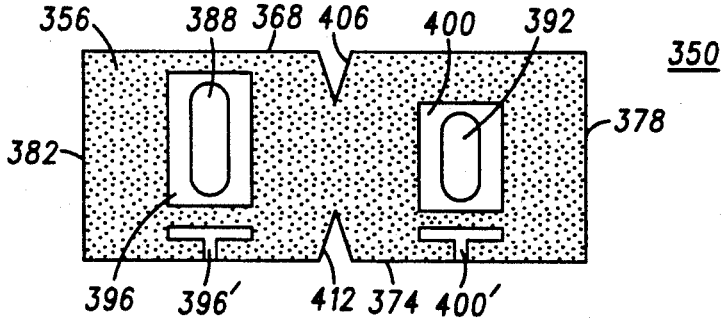
FIG. 7 is a plan view, similar with those of FIGS. 4–6, but taken from above the top surface of a dielectric filter of another alternate, preferred embodiment of the present invention.

FIG. 7 is a plan view taken from above the top surface of a dielectric filter of yet another alternate, preferred embodiment of the present invention. The filter, referred to generally by reference numeral 350, includes top surface 356 defined by edge surfaces of first and second side surfaces 368 and 374, and front and rear side surfaces 374 and 382. Openings defined by longitudinally-extending cavities 388 and 392 define openings upon top surface 356. Portions of top surface 356 are coated with an electrically-conductive material, here indicated by painted areas 396, 396', 400, and 400' are capacitively coupled theretogether. Filter 350 of FIG. 7 differs from filter 50 of FIGS. 3–4 in that both cavities 388 and 392 are of cross-sectional areas elongated in transverse direction.

Figure 8:
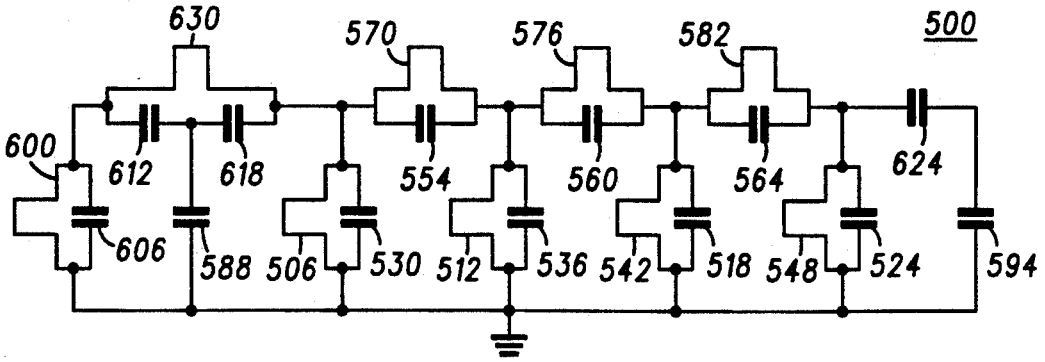
FIG. 8 is a circuit diagram of a four pole, bandpass filter representing, in circuit schematic form, a filter of a preferred embodiment of the present invention.

Turning next to FIG. 8, a circuit diagram, referred to generally by reference numeral 500 of a four pole, dielectric filter is shown. The four pole filter includes four resonating cavities, here indicated by transmission lines 506, 512, 518, and 524. Positioned in parallel with transmission lines 506–524 are capacitors 530, 536, 542, and 548, respectively. Capacitors 530–548 represent capacitive loadings between painted areas formed upon top surfaces of a dielectric filter and a ground plan (wherein the ground plane is comprised of side surfaces of the dielectric filter).

Capacitive coupling between painted areas formed upon a top surface of the dielectric filter are represented by capacitors 554, 560, and 564. Electromagnetic intercoupling between adjacent ones of the resonating cavities are represented by transmission lines 570, 576, and 582 positioned in parallel with capacitors 554–564, respectively.

Input and output electrodes are represented by capacitors 588 and 594. A fifth resonating cavity, constructed to form a shunt zero, is represented by transmission lines 600, and a painted area formed upon a top surface of the dielectric filter and coupled to the resonator is indicated by capacitor 606. Capacitive coupling between the painted area (represented by capacitor 606 and an input electrode of the dielectric filter is represented by capacitor 612). Capacitive coupling between the input electrode and a resonating cavity of the dielectric filter is represented by capacitor 618, and capacitive coupling between the output electrode of the dielectric filter and a resonating cavity is represented by capacitor 624. Electromagnetic coupling between the resonator forming shunt zero and a resonating cavity positioned adjacent thereto is represented by transmission line 630.

FIG. 9 is a schematic representation of a dielectric filter, referred to generally by reference numeral 700, represented in circuit diagram form in FIG. 8 by circuit 500. Filter 700 is mounted upon an electrical circuit board 702. Filter 700 comprises resonating cavities 706, 712, 718, and 724 extending longitudinally therethrough. Cavities 706 and 718 are of elliptical, cross-sectional areas in which transverse axes thereof are elongated in length. Painted areas 730, 736, 742, and 748 are formed upon top surface 750 of filter 700. Painted areas 788 and 794 are also formed upon top surface 750 of filter 700. Painted areas 788 extend to the side surface of filter 700 seated upon circuit board 702 and are electrically connected to input and output couplers formed on such surface. (While the input and output couplers are hidden from view in the Figure, the couplers are similar to couplers 136 and 142 of filter 50 shown in FIG. 3.) A fifth resonating cavity, represented by reference numeral 800 is further formed to extend longitudinally through filter 700, and painted area 806 is further formed upon top surface 750. Volumes of dielectric material are removed from first and second side surfaces 810 and 814 between adjacent ones of the resonating cavities 706–718 and 800 to form thereby notches 818, 824, 830, 836, 842, 848, 856, 862, 868, and 874. Selection of the location of, and dimension of notches 818–874, and the lengths of elongation of transverse axes of the cross-sectional areas of cavities 706 and 718 alter the component values of the component elements of the filter. For instance, notches 824 and 856 extending longitudinally along first and second side surfaces 810 and 814, respectively, alter the amount of electromagnetic coupling between resonating cavities 706 and 712. Hence, the dimensions of notches 824 and 856 are determinative of the value of transmission line 570 of circuit 500 of FIG. 8. Also, by analogy, the elongation of the transverse axis of the cross-sectional area of cavity 706 is determinative of the value of transmission line 506 of circuit 500 of FIG. 8. The effects of other ones of the notches 818–874 may be similarly shown. Hence, by appropriate configuration of filter 700 by, for example, formation of and dimensions of notches 818–874 and configuration of resonating cavities 706–748 and 800, the filter characteristics of the filter may be selected as desired. Increase in the physical dimension of the filter is not required, as appropriate alternation of the filter may cause the filter be of the desired filter characteristics.

Figure 10:
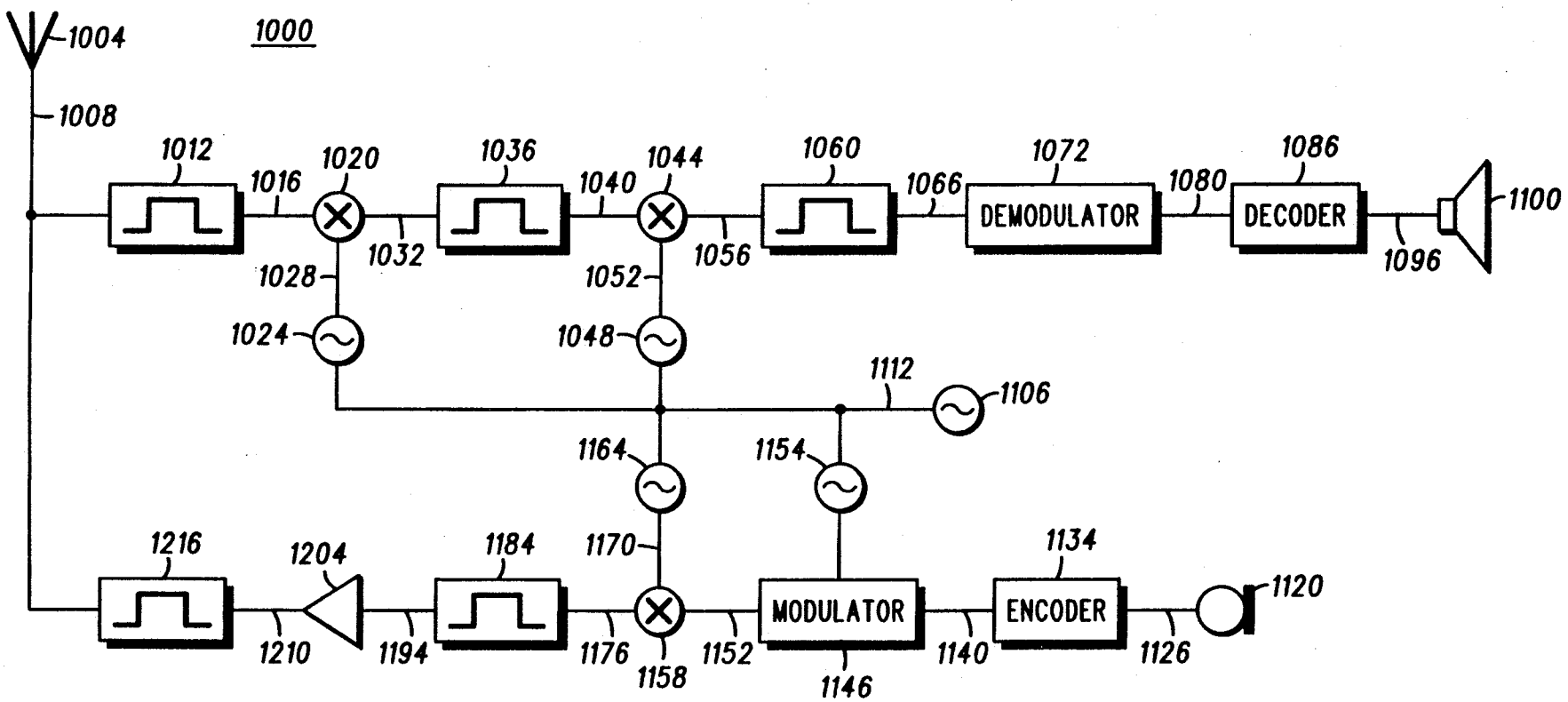
FIG. 10 is a block diagram of a radio transceiver of a preferred embodiment of the present invention which incorporates the filter of, for example, FIG. 9.

Turning next to the block diagram of FIG. 10, a radio transceiver, such as a radiotelephone, referred to generally by reference numeral 1000, of a preferred embodiment of the present invention is shown. Transceiver 1000 includes a dielectric filter, such as a dielectric filter described with respect to one or more of the preceding figures, as a portion thereof. The top portion of transceiver 1000 represents the receiver circuitry of the transceiver, and the bottom portion of the figure represents the transmitter portion of the transceiver.

A signal transmitted to the transceiver is received by antenna 1004 which converts the electromagnetic signal into an electrical signal on line 1008. Line 1008 is coupled to filter 1012 which generates a filtered signal on line 1016. Line 1016 is coupled to a first input of mixer 1020. An oscillating signal generated by oscillator 1024 is supplied to a second input of mixer 1020 by way of line 1028.

Mixer 1020 generates a down-mixed signal on line 1032 which is supplied to filter 1036. Filter 1036 generates a filtered signal on line 1040 which is coupled to a first input of second mixer 1034 by way of line 1052.

Second mixer 1044 generates a second, down-mixed signal on line 1056 which is applied to filter 1060. Filter 1060 generates a filtered signal on line 1066 which is applied to demodulator 1072. Demodulator 1072 generates a demodulated signal on line 1080 which is applied to decoder 1086. Decoder 1086 generates a decoded signal on line 1096 which is applied to a transducer, such as speaker 1100.

Reference oscillator 1106 generates an oscillating signal on line 1112 which is applied to oscillators 1024 and 1048 to maintain the oscillating frequencies of oscillators 1024 and 1048 in a known relation with the oscillation frequency of oscillator 1106.

The transmitter portion of transceiver 1000 includes microphone 1120 which converts a voice signal into an electrical signal on line 1126. Signals generated on line 1126 are applied to encoder 1134 which generates an encoded signal on line 1140 which, in turn, is applied to modulator 1146. An oscillating signal generated by oscillator 1154 is further applied to modulator 1146.

Modulator 1146 generates a modulated signal on line 1152 which is applied to a first input of mixer 1158. An oscillating signal generated by oscillator 1164 is applied to a second input of mixer 1158 by way of line 1170. Mixer 1158 generates an up-mixed signal on line 1176 which is applied to filter 1184. Filter 1184 is a transmitter clean-up filter similar to one of the dielectric filters shown in the preceding figures.

Filter 1184 generates a filtered signal on 1194 which is applied to amplifier 1204. Amplifier 1204 generates an amplified signal on line 1210 which is applied to filter 1216. Filter 1216 generates a filtered signal which is applied to antenna 1004 to transmit the filter signal therefrom.

Turning finally now to FIG. 11, a logical flow diagram, referred to generally by reference numeral 1300 is shown. Method steps of the method of the present invention are enumerated therein.

First, and as indicated by block 1306, at least one pair of coaxially-extending resonators are formed to extend longitudinally through the dielectric block. At least one resonator is of a cross-sectional area elongated in a direction transverse to the longitudinal axis of the resonator.

Next, and as indicated by block 1312, volumes of dielectric material are removed from at least one side surface of the dielectric block to alter thereby the electromagnetic coupling between the individual ones of the resonators.

While the present invention has been described in connection with the preferred embodiments shown in the various figures, it is to be understood that other similar embodiments may be used and modifications and additions may be made to the described embodiments for performing the same function of the present invention without deviating therefrom. Therefore, the present invention should not be limited to any single embodiment, but rather construed in breadth and scope in accordance with the recitation of the appended claims.

What is claimed is:

1. A filter construction for generating a filtered signal responsive to application of an input signal thereto, said filter construction comprising:

a dielectric block defining top, bottom, and at least first and second side surfaces;

at least two longitudinally-extending resonators defined by sidewalls of cavities formed to extend longitudinally along longitudinal axes thereof between the top and bottom surfaces of the dielectric block, the at least two longitudinally-extending resonators including a pair of adjacently positioned resonators wherein a first resonator of the pair of adjacently positioned resonators is of a circular cross-section and a second resonator of the pair of adjacently positioned resonators is of a substantially elliptical cross-section;

a coating of an electrically-conductive material substantially covering the bottom and the at least first and second side surfaces and the sidewalls of the cavities defining the at least two longitudinally-extending resonators thereby to permit electromagnetic coupling between adjacent ones of the at least two resonators;

means forming a notch positioned to extend along at least one of the first and second side surfaces of the dielectric block at a location between the first resonator and the second resonator of the pair of adjacently positioned resonators, for altering the electromagnetic coupling between the pair of adjacently positioned resonators of the at least two longitudinally-extending resonators.

2. The filter construction of claim 1 wherein said means forming the notch is of a V-shaped cross section.

3. The filter construction of claim 1 wherein said means forming the notch is positioned to extend longitudinally along entire lengths of the at least one of the first and second side surfaces.

4. The filter construction of claim 1 wherein said means forming the notch comprises a first notch portion formed to extend longitudinally along the first side surface and a second notch portion formed to extend longitudinally along the second side surface.

5. The filter construction of claim 4 wherein said first notch portion and said second notch portion are formed to extend longitudinally along the first and second side surfaces, respectively, at locations of similar distances between the pair of adjacently positioned resonators of the at least two longitudinally-extending resonators.

6. In a radio transceiver having transmitter circuitry and receiver circuitry, the combination with the transmitter circuitry of a transmitter clean-up filter, said transmitter clean-up filter comprising:

a dielectric block defining top, bottom, and at least first and second side surfaces;

at least two longitudinally-extending resonators defined by sidewalls of cavities formed to extend longitudinally along longitudinal axes thereof between the top and bottom surfaces of the dielectric block, the at least two longitudinally-extending resonators including a pair of adjacently positioned resonators wherein a first resonator of the pair of adjacently positioned resonators is of a circular cross-section and a second resonator of the pair of adjacently positioned resonators is of a substantially elliptical cross-section;

a coating of an electrically-conductive material substantially covering the bottom and the at least first and second side surfaces and the sidewalls of the cavities defining the at least two longitudinally-extending resonators thereby to permit electromagnetic coupling between adjacent ones of the at least two resonators;

means forming a notch positioned to extend along at least one of the first and second side surfaces of the dielectric block at a location between the first resonator and the second resonator of the pair of adjacently positioned resonators for altering the electromagnetic coupling between the pair of adjacently positioned resonators of the at least two longitudinally-extending resonators.

7. A method for constructing a dielectric filter of a block of dielectric material having top, bottom, and at least first and second side surfaces, said method comprising the steps of:

forming at least two longitudinally-extending resonators defined by sidewalls of cavities to extend longitudinally along longitudinal axes thereof between the top and bottom surfaces of the dielectric block, the at least two longitudinally-extending resonators including a pair of adjacently positioned resonators wherein a first resonator of the pair of adjacently positioned resonators is of a circular cross-section and a second resonator of the pair of adjacently positioned resonators is of a substantially elliptical cross-section;

covering the bottom and the at least first and second side surfaces of the dielectric block and the sidewalls of the cavities defining the at least two longitudinally-extending resonators with a coating of an electrically-conductive material thereby to permit electromagnetic coupling between adjacent ones of the at least two resonators; and molding a longitudinally-extending notch in the dielectric material forming the dielectric filter at least one side surface of the first and second side surfaces of the dielectric block between the first resonator and the second resonator of the pair of adjacently positioned resonators to alter thereby the amount of dielectric material separating the first and resonator and the second resonator of the pair of adjacently positioned resonators to alter thereby the electromagnetic coupling between the individual ones of the resonators of the at least one pair of resonators.

8. The method of claim 7 wherein said step of molding the notch comprises molding a first notch portion longitudinally along the first side surface of the dielectric block, and molding a second notch portion longitudinally along the second side surface of the dielectric block.

9. The method of claim 8 wherein the first notch portion molded along the first side surface of the dielectric block and the second notch portion molded along the second side surface of the dielectric block extend along the first and second side surfaces, respectively, at locations of similar distances between the first resonator and the second resonator of the pair of adjacently-positioned resonators formed during said step of forming.

* * * * *